US007692552B2

(12) United States Patent
Harrington et al.

(10) Patent No.: US 7,692,552 B2
(45) Date of Patent: Apr. 6, 2010

(54) METHOD AND SYSTEM FOR IMPROVING DRIVER SAFETY AND SITUATIONAL AWARENESS

(75) Inventors: Nathan J. Harrington, Cary, NC (US); Chandrasekhar Narayanaswami, Wilton, CT (US)

(73) Assignee: International Business Machines Corporation, Armonk, NY (US)

( * ) Notice: Subject to any disclaimer, the term of this patent is extended or adjusted under 35 U.S.C. 154(b) by 464 days.

(21) Appl. No.: 11/626,097

(22) Filed: Jan. 23, 2007

(65) Prior Publication Data

US 2008/0174451 A1 Jul. 24, 2008

(51) Int. Cl.
*G08B 23/00* (2006.01)

(52) U.S. Cl. ..... 340/576; 340/573.1; 340/439; 340/905; 180/272

(58) Field of Classification Search ..... 340/575, 340/576, 905, 439, 573.1; 180/280, 272; 600/372, 390, 503, 546, 547
See application file for complete search history.

(56) References Cited

U.S. PATENT DOCUMENTS

| | | | | |
|---|---|---|---|---|
| 4,540,979 | A * | 9/1985 | Gerger et al. | 340/576 |
| 5,574,641 | A * | 11/1996 | Kawakami et al. | 701/1 |
| 6,265,978 | B1 * | 7/2001 | Atlas | 340/575 |
| 2003/0076968 | A1 * | 4/2003 | Rast | 381/124 |
| 2004/0208496 | A1 * | 10/2004 | Pilu | 396/263 |

* cited by examiner

*Primary Examiner*—Anh V La
(74) *Attorney, Agent, or Firm*—Cantor Colburn LLP; Ken Corsello

(57) ABSTRACT

A method for enhancing driver safety through body position monitoring with remote sensors, and furnishing feedback in response to vehicle motion, driver activities, and external driving conditions, wherein the method includes: monitoring and characterizing signals from at least one sensor mounted on the body of a driver; monitoring and characterizing signals from at least one vehicle mounted sensor; determining driver activity based on disambiguating the signals from the driver and vehicle mounted sensors; providing feedback to the driver based on the determined driver activity, vehicle motion, and external driving conditions; and wherein the feedback is employed to modify driver behavior and enhance driver safety.

19 Claims, 2 Drawing Sheets

METHOD AND SYSTEM FOR IMPROVING DRIVER SAFETY AND SITUATIONAL AWARENESS

TRADEMARKS

IBM® is a registered trademark of International Business Machines Corporation, Armonk, N.Y., U.S.A. Other names used herein may be registered trademarks, trademarks or product names of International Business Machines Corporation or other companies.

BACKGROUND OF THE INVENTION

1. Field of the Invention

This invention relates generally to electronic monitoring and real-time safety feedback and behavior modification, and more particularly to providing a method, auricle, and system for enhancing driver safety through body position monitoring with remote sensors, and furnishing feedback in response to vehicle motion, driver activities, and external driving conditions.

2. Description of the Related Art

Advancements in vehicle safety have progressed over the years, with new safety features and enhancements introduced with successive generations of vehicles. Safety features have evolved either by government mandate, or market driven demand. Early safety features included radial tires, padded dashboards, safety glass, and passive restraints (seat belts). The current generation of vehicles comes equipped with a myriad of safety features including front and side airbags, antilock brakes, vehicular steering assist, lane departure warning, collision avoidance systems, run flat tires, night vision systems, etc. The present day safety features rely on onboard vehicle equipped sensors and computers to monitor environmental, road, and vehicle conditions and parameters, as well as to provide feedback to the key vehicle safety and control systems. However, the feedback and control systems do little to monitor driver behavior.

Previous work with "lightweight" wearable computing technology for activity detection required the use of bulky hardware and physical modification of objects for recognition. Video processing, physiological monitoring devices, and other "heavyweight" sensors have had success in determining stress levels of a general user and broad context activities. Consumer level wearable computers, such as Personal Digital Assistants and upcoming cellular phones, can provide integrated accelerometer sensors for activity detection based on the kinematics of the human body as a whole. However, these consumer level wearable computers have limited utility in a vehicle environment, as the driver is in a seated position, and the accelerometer readings would not be able to distinguish driver from passenger activities unless mounted on an upper limb.

Recent efforts with ubiquitous and wearable sensors in the vehicular context have demonstrated the value of multi-sensory inputs to the driver to enhance situational awareness. Studies using vibro-tactile stimulators on the driver's torso have decreased the response time to critical events in simulations, and at least one car company has deployed a vibro-tactile warning system for unexpected lane departure. Additional research has created environmental and navigational control interfaces that significantly enhance the time drivers spend with their eyes and attention focused on the road, instead of the control interface. Vibro-tactile feedback mechanisms to both traffic-related and control-activation information have been shown to be highly beneficial in the vehicular context due to its low impact on the driver's analytical processes, while retaining the ability to be easily integrated into the driver's task workload. Vibro-tactile feedback can also be delivered privately compared to audio or graphical means. Work has been conducted with piezo-electric sensors and motors to provide haptic feedback on mobile computing/communication devices to facilitate vision free interaction. It has been found that users are able to distinguish between several "tactons"-tactile icons. However, these test to determine how many patterns a user is able to detect have been conducted under ideal conditions where the user is stationary and mainly focusing on haptic pattern detection, and not on a primary activity such as driving in a moving vehicle.

SUMMARY OF THE INVENTION

Embodiments of the present invention include a method for enhancing driver safety through body position monitoring with remote sensors, and furnishing feedback in response to vehicle motion, driver activities, and external driving conditions, wherein the method includes: monitoring and characterizing signals from at least one sensor mounted on the body of a driver; monitoring and characterizing signals from at least one vehicle mounted sensor; determining driver activity based on disambiguating the signals from the driver and vehicle mounted sensors; providing feedback to the driver based on the determined driver activity, vehicle motion, and external driving conditions; and wherein the feedback is employed to modify driver behavior and enhance driver safety.

A system for enhancing driver safety through body position monitoring with remote sensors, and furnishing feedback in response to vehicle motion, driver activities, and external driving conditions, wherein the system includes a computing device in electrical signal communication with a network of sensors; wherein the network of sensors include: at least one sensor mounted on the body of a driver; at least one vehicle mounted sensor; and wherein the computing device is configured to execute electronic software that manages the network of sensors; wherein the electronic software is resident on a storage medium in signal communication with the computing device; and wherein the electronic software determines driver activity based on disambiguating the signals from the driver and vehicle mounted sensors, and provides feedback to the driver based on the determined driver activity, vehicle motion, and external driving conditions; and wherein the feedback is employed to modify driver behavior and enhance driver safety.

An article including machine-readable storage media containing instructions that when executed by a processor enable the processor to manage a system for enhancing driver safety through body position monitoring with remote sensors, and furnishing feedback in response to vehicle motion, driver activities, and external driving conditions, wherein the system includes a computing device in electrical signal communication with a network of sensors; and wherein the network of sensors includes: at least one sensor mounted on the body of a driver; at least one vehicle mounted sensor; and wherein the computing device is configured to execute electronic software containing the instructions that manage the network of sensors; wherein the electronic software is resident on a storage medium in signal communication with the computing device; and wherein the electronic software determines driver activity based on disambiguating the signals from the driver and vehicle mounted sensors, and provides feedback to the driver based on the determined driver activity, vehicle motion, and external driving conditions; and wherein the feedback is employed to modify driver behavior and enhance driver safety.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

Figure 1:
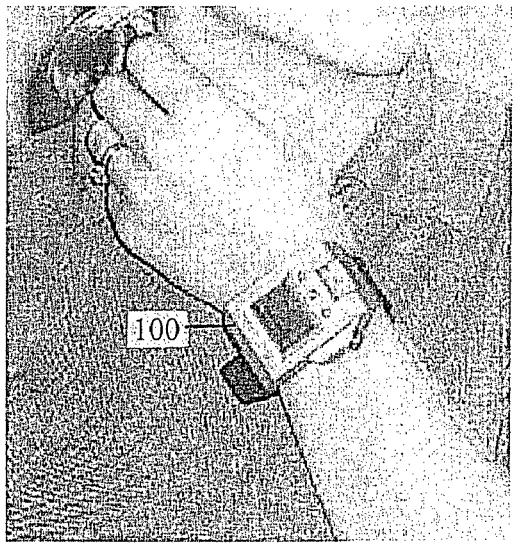
FIG. 1 is a pictorial representation of the wrist mount vibro-tactile feedback mechanism in the form of IBM's WatchPad according to an embodiment of the invention.

The detailed description explains the preferred embodiments of the invention, together with advantages and features, by way of example with reference to the drawings.

DETAILED DESCRIPTION OF SPECIFIC EMBODIMENTS

Embodiments of the present invention provide a method, article, and system for enhancing driver safety through body position monitoring with remote sensors in response to vehicle motion, driver activities, and external driving conditions. Embodiments of the present invention outfit drivers with wearable sensors and computers for the purpose of monitoring driver behavior and inducing behavior modification. An embodiment of the present invention exploits the sensory input recognition threshold of drivers responding to wrist-located vibro-tactile events, and employs an algorithm for detecting whether a driver has their hand on the steeling wheel. Road tests with several drivers subjected to varying road conditions (including stressful driving conditions) are used to create a model for required duration for event notification based upon real-time vehicle dynamics. One embodiment of the present invention provides driver behavior modification during stressful driving conditions utilizing a wrist mounted vibro-tactile feedback mechanism (for example, IBM's WatchPad) and vehicle mounted accelerometer sensor data. Additional embodiments of the present invention can monitor if the driver is holding the steeling wheel correctly, if their drowsy, eating while driving, holding a cell phone, and either warning the user or changing vehicle system parameters to compensate. The safety features of the present invention can be incorporated into newly sold cars, or sold as after market equipment by insurance companies, for example.

Recent advances in miniaturization of spatial orientation sensors, wireless networking, and platform integration have created a new class of wearable computers. These advanced systems are differentiated from experimental and domain-specific wearable computers by their unobtrusive physical dimensions and availability as consumer grade devices. The IBM WatchPad is an example of a wearable computer in the sense that it does not get in the way of everyday life, and yet still provides a robust computing platform running a full operating system and sensor suite. As previously stated, an embodiment of the present invention integrates the WatchPad into the vehicle's sensory input environment, thereby increasing situational awareness and enhancing the safety of the driving process. Information about the sensory input recognition threshold of vibro-tactile events on the driver's wrist via the WatchPad is utilized as a feedback mechanism that takes advantage of the drivers ability to determine with a coarse resolution vibratory events while operating a vehicle under real-world driving conditions, and consistently integrating the processing the vibro-tactile events into their task hierarchy.

A first embodiment of the present invention combines activity detection of the upper limb wearable device with in-vehicle sensors to detect the current activity of the driver's wrist, and modifies the driving behavior based on that activity, by determining the mean temporal-duration and temporal-pattern resolution of wrist located vibro-tactile events during various levels of driving-related stress. An algorithm is employed to determine wrist activity with enhanced disambiguation using vehicle attached onboard sensor data. Based on the algorithm, a notification model to reliably notify the driver of critical events through the vibro-tactile interface without triggering a startle reflex or causing inattentiveness to critical driving activities.

The wrist-mounted device of an embodiment of the present invention is capable of sensing the position of the driver's wrist and also provides vibro-tactile feedback. An example of a wrist-mounted device used in developing an embodiment of the present invention is the aforementioned IBM WatchPad 100 that is depicted in FIG. 1. The WatchPad provides vibro-tactile feedback and also acts as an accelerometer data collection sensor with a small form factor and onboard processing capabilities. The WatchPad runs on a Linux kernel and employs Bluetooth wireless communication, and incorporates vibrational motors to provide the vibro-tactile feedback.

Table 1 lists twelve monitored driving activities used for data collection to establish the operational parameters of the first embodiment of the present invention. The monitored activities were common driving tasks associated with real-world activities, and were performed in suburban and rural environments. All data collection runs were performed during daylight conditions with normal traffic flow and weather conditions. To conduct the driving, five drivers of widely varying experience levels, genders, and familiarity with wearable computing devices were selected. The mean length of driver experience was 12.8 years, and their mean age was 32.4 years. Participants were given a basic description of the experimental process and were instructed to describe the duration and temporal-pattern characteristics of the vibro-tactile input to their wrist while driving. The mean duration of the data collection runs was 18.2 minutes. A laptop computer equipped with accelerometers was mated with the vehicles chassis to record roll and pitch movements of the vehicle independent of the wrist mounted monitoring device. The accelerometer measurements from the laptop were used to providing disambiguation of the wrist mounted (WatchPad) accelerometer data during the signal analysis phase.

TABLE 1

| Activity | Description |
|---|---|
| 1 | Parking Lot Navigation |
| 2 | Pulling into parking space |
| 3 | Pulling out of parking space |

TABLE 1-continued

| Activity | Description |
|---|---|
| 4 | Left turn across traffic |
| 5 | Right turn with no stop |
| 6 | Straight line acceleration |
| 7 | Merging onto highway |
| 8 | Braking for stoplight |
| 9 | Braking for stop sign |
| 10 | Backing out of a parking space |
| 11 | Backing into a parking space |
| 12 | Driving on gravel road |

Figure 2:
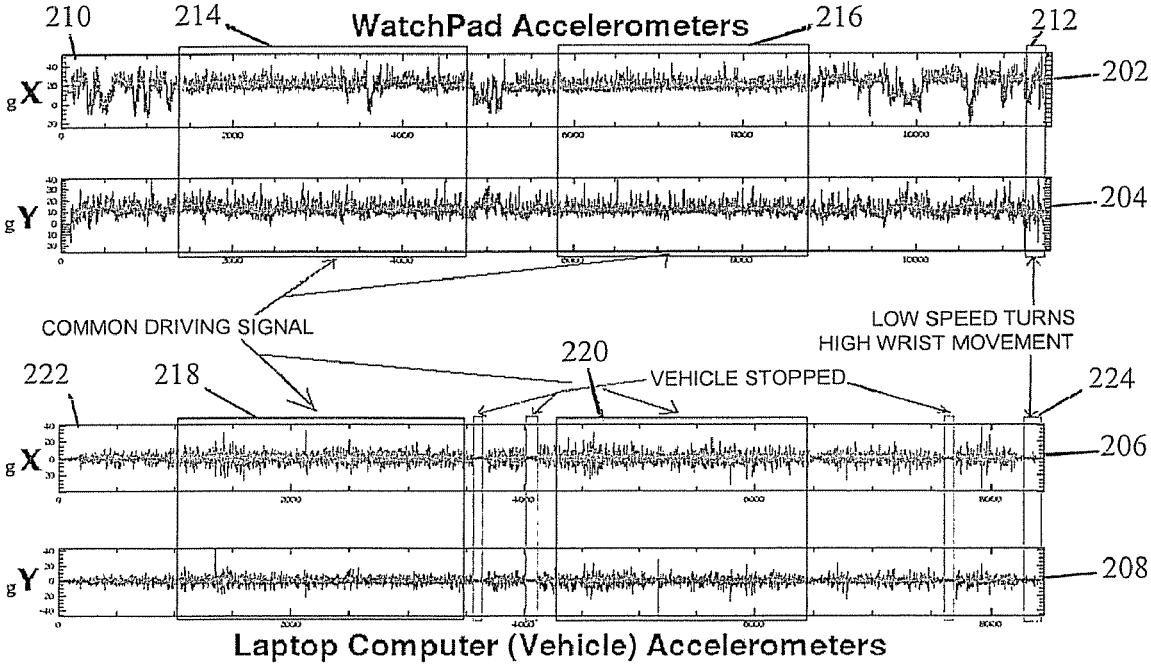
FIG. 2 illustrates typical accelerometer data acquired from the wrist mounted vibro-tactile feedback mechanism and vehicle sensors according to an embodiment of the invention.

During the data acquisition phase the drivers wore the WatchPad on the right or left wrist (depending on their preference), while the laptop computer recorded real-time 5 Hz telemetry from the WatchPad bi-axial accelerometer data (see FIG. 2). Measurements of the vehicle's roll and pitch were recorded at 10 Hz on the accelerometers in the laptop (see FIG. 2). After a brief demonstration to the driver of the type of vibration to expect, the experimenter (a co-passenger in the test vehicle) began data collection runs, and supplied simple navigational instructions during the run. During various points in the data collection runs, vibro-tactile events of specific temporal-duration and temporal-patterns were sent to the driver's wrist mounted device, with the driver providing verbal feedback on the type of event sensed. For example, during a driving activity listed in Table 1, the experimenter would send a temporal-pattern event (two quick buzzes, for example) to the driver's WatchPad from the onboard laptop. The controlling laptop recorded the time the temporal-pattern event was sent, and the experimenter recorded the driver's response rate when the driver responded with a description of the event they sensed. The driver response rate is the elapsed time between when the temporal-pattern event signal was sent and when the driver responded. The laptop also provided accelerometer trending data and three-dimensional representations of the orientation of the WatchPad and laptop that provided in situ tools for annotation and variability monitoring for analysis. Secondary sensor integration is also possible with onboard vehicle hardware, or with other wearable computers the driver might have. For example, some personal digital assistants (PDA) come equipped with accelerometers that can measure the characteristic motion of a vehicle from the wear's pocket, and provide disambiguation data to the WatchPad. In addition, a video camera was used to capture the exchanges between the drivers and experimenter for analysis. The video of the driving process, the time-coded annotation of events, and subsequent driver responses were recorded. Playback and analysis of experimental runs were performed at various rates to determine what characteristics of the accelerometer data indicated a driving condition, and what types of vibro-tactile events the drivers under differing levels of stress detected. The annotation and video recording of the data collection runs was critical in correlating what signals can be expected from the wrist mounted WatchPad while the drivers had their hands on the vehicle steering wheel. Additionally, the video recording and environmental factors annotation were critical in examining the variability related to vibro-tactile sensory threshold due to stressful driving conditions. The data collected during the experimentation process provided the following unique parameters:

Real-world data collection of the spatial orientation of the driver's wrist during unpredictable driving events.

Impact on driver workload of wrist mounted vibro-tactile events.

Temporal-pattern resolution threshold of wrist-located vibro-tactile events during stressful driving activities.

Previous work related to vibro-tactile feedback has shown that drivers readily recognize vabro-tactile events of sufficient temporal duration. Peripheral vision detection tasks, such as monitoring informational readout displays on the vehicle dashboard are more difficult to detect, or require increased persistence to ensure driver detection. Visual and audible alerts in the automotive context can be difficult to detect for drivers with decreased visual and audio sensory capabilities. Research has shown that while many drivers have decreased vision and hearing capabilities with age, their sense of touch continues relatively unchanged throughout life. The data collected during the experimentation process in the development of the first embodiment of the present invention showed that although the wrist located vibro-tactile events were consistently detected, their temporal-pattern characteristic determination is heavily impacted by specific driver activity. In addition, the cognitive ability of the user to continue driving activities while reporting on the characteristics of the current vibration event is also heavily dependent on current stress levels.

While performing straight-line driving tasks at low or high speed (such as driving activities 6, 8, 9 or 12 from Table 1), drivers were able to almost immediately describe the temporal-duration and temporal-pattern characteristics of the vibration events received through the WatchPad. For example, the "straight line acceleration event"—number 6 from Table 1, had a mean approximate driver-notification response time of 0.5 seconds, an approximate temporal-duration accuracy rating of 75%, and an approximate temporal-pattern accuracy rating of 95%. During nearly every straight line acceleration event, whether rural or suburban, inexperienced driver or seasoned, the driver was capable of determining quickly that a vibration event had occurred, its approximate duration, and whether it was a multiple quick-vibration event, Average accuracy ratings are used due to the variability of driver's internal timing capabilities and estimates, and variability in the Watchpad's vibration timing code.

Conversely, during stressful driving events, such as parking lot maneuvering (activity 1, 2, 3, 10, and 11), or highway related events (activity 7) driver recognition of nearly all vibro-tactile events from the WatchPad is severely degraded. During parking lot maneuvering events, mean approximate driver notification response time increased five fold to 2.5 seconds, approximate temporal-duration accuracy was 75%, and approximate temporal-pattern accuracy was 5.6%

Activity 12 (Table 1)—driving on a gravel road—was included in the experiment to help disambiguate steering wheel induced vibrations from WatchPad vibro-tactile events. During testing, the low order vibrations transmitted through the steering wheel were easily differentiated from WatchPad vibrations even when driving over potholes and rough road sections. There was no appreciable change from data collected during driving on regular asphalt roads in any of the measured driver response characteristics.

Of particular note is the loss of cognitive ability to reliably determine multiple quick-vibration events during stressful driving conditions. Although easily recognized during straight-line low-stress activities, drivers only 5.6% of the time recognized a pause of 0.5 seconds between vibration events. In the remainder of the cases, the driver described a single vibration event. Although the driver was unable to rapidly describe the characteristics of the event received, and the pause between vibration events was beyond the cognitive abilities of most drivers under most circumstances, coarse recognition of the duration of the vibration event was still reliably acquired.

A vibro-tactile event of duration greater than 3 seconds was accurately recognized by drivers under all driving conditions, and forms the basis of the notification system of the present invention. Notification events under "maximum" stress will require a notification of at a minimum 3 seconds, and lower stress events will have a correspondingly shorter minimum duration of notification. This approach allows for further intergration of non-critical events (such as in-vehicle information system events) into the notification scheme.

Table 2 shows the weighted scale of stressfulness of selected driving activities that were listed in Table 1.

TABLE 2

| Activity | Description | Stressfulness |
|---|---|---|
| 1 | Parking lot navigation | 2.5 |
| 2 | Pulling into parking space | 4.1 |
| 3 | Pulling out of parking space | 2.8 |
| 4 | Left turn across traffic | 5.2 |
| 7 | Merging onto highway | 5.7 |
| 10 | Backing out of a parking space | 4.4 |
| 11 | Backing into a parking space | 2.6 |

The values in the stress-indicator column of Table 2 are derived from the following formula:

$$S=(\Sigma((evr_i*evs_i)/n)/(str_j*sts_j))$$

where evr is the driver description response rate for a straight line driving activity; evs is the temporal pattern accuracy of the activity; str is the response rate for the stressful driving activity; and sts is the temporal-pattern accuracy for the stressful driving activity. The stressfulness (S) of activity j, is determined by the average value for all straight-line activities divided by the value for event j. Values of S closer to one indicate a low-stress activity, and higher values indicate a high-stress activity. Using this formula, the relative stressfulness of any driving activity can be computed. Combining the computed stressfulness with the acquisition of information about the current wearer's (driver) activity and vehicle dynamics, a model can be created for efficient notification of driver activity.

Time code annotated logs of the data collection runs provided a set of time intervals with which the driver had their WatchPad-worn wrist hand located on the steering wheel. In real-world driving, it was discovered that 80% of the time the vehicle is under medium G load acceleration, between 0.1 and 0.5 G, the driver's hand is on the steering wheel. Medium G loads events include negotiating a highway on-ramp, cross traffic turning, and gravel road driving, amongst others. Low G load acceleration events of the vehicle, such as negotiating a parking lot, or backing out of a driveway frequently show the driver's hand off the steering wheel. The torso position of the driver while in reverse gear, and the rapid steering wheel movements associated with these activities frequently prevent the users hand from touching the steeling wheel for significant time periods.

Conversely, the majority of driving activities involve low-level steering wheel inputs on relatively straight paths in both suburban and rural environments. For example, the wrist rarely moves more than 9 centimeters in the vertical dimension or 4 centimeters in the horizontal while negotiating curves at highway speeds. Even with deflections from center steering wheel position of 30 degrees, the acceleration measured from the WatchPad vertical and horizontal accelerometers remains relatively constant.

FIG. 2 illustrates data collected from wrist and vehicle mounted accelerometers from a typical experimental run. In regions 210, 212, 222, and 224 located near the beginning and end of the sampling timelines (x-axis shows time in milliseconds) (202, 204, 206, 208) for recorded movements in the x and y spatial domain (gX and gY, respectively), the WatchPad accelerometers registered a high rate of wrist movement that can be associated with a rapidly moving steering wheel that is characteristic of parking lot maneuvers with low speed turns. Regions 214, 216, 218, and 220 represent the "Common Driving Signal" that refers to the most frequently repeated characteristics of data measurement during experimentation. Specifically, gX-axis (202) measurements of 24 centimeters, and gY-axis measurements (204) of 12 centimeters during the various periods the driver had their hands upon the steering wheel. Empirical observations show that a gX-axis measurement of 24 centimeters roughly corresponds to a 31 degree angle of the driver's wrist, as measured with a "zero" state being the driver's forearm parallel to the earth's surface. A gY-axis measurement of 12 centimeters corresponds to a 14 degree angle of the driver's wrist when the driver's arm is held perpendicular to the earth's surface as a "zero" state.

For the large data set of various driving routes, vehicles and individuals, a broad time window was required to definitively determine that the driver had their hand on the steering wheel. For any given time window of 10 seconds, if the ratio of gX=±24 cm and gY=±12 cm to gX≠±24 cm and gY≠±12 cm is greater than 40%, it can be concluded that the diver is operating the steering wheel. The large time window is necessary to compensate for control usage, such as turn signal activation, or the driver scratching their face. The data derived during the aforementioned experimentation process provides the capability to recognize when the driver does not have their hand on the steering wheel while the vehicle is in motion, as well as appropriate duration of notifications required to ensure reliable communication of vibro-tactile events.

Inattentiveness is a major factor in vehicle accidents, and while the wrist mounted vibro-tactile feedback mechanism (IBM's WatchPad) is not equipped to monitor cognitive inattentiveness, it can discern secondary activities, which may indicate the driver is not satisfactorily involved in the driving process. During the experimentation/data acquisition phase, many drivers were observed placing their WatchPad located arm down onto the armrest, especially on rural roads under straight line driving conditions. While this activity is not necessarily an indicator of decreased focus on the driving task, having both hands on the wheel is the ideal driving condition. The WatchPad vibro-tactile interface is well suited for informing the driver of their hand position, as the closely coupled feedback mechanism will reduce the cognitive load on the driver. Unlike audible alerts or visual cues to place their hand back on the wheel, the vibration of the WatchPad is an alert mechanism located directly on the physical appendage that needs to relocate. In addition, vibro-tactile feedback can be private. Previous work in vibro-tactile alert systems signal the driver to monitor other information systems in the vehicle, whereas the model provided by embodiments of the present invention facilitate direct physical behavior altering cues for the driver, with minimal cognitive load. For example, if the vehicle is in motion, and the driver's hand is not on the steering wheel, a vibro-tactile alert of specific duration, where the duration is based upon the stress-factor of the current driving activity, is initiated. If the stressfulness of the current driving activity is greater than the minimum threshold, a vibro-tactile alert of about 3 seconds in duration is sent to the wrist mounted WatchPad vibro-tactile interface.

Exceptions are made if the driver's hand is not on the wheel for parking lot events. Due to factors requiring extreme wrist motion away from the wheel during normal parking lot activities, if the onboard accelerometer is indicating low-speed g-force events, then the vibro-tactile alerts will not be sent. Critical vehicle informational events (such as brake failure) can still be sent to the WatchPad with a duration appropriate to the stressfulness of the parking lot navigation activity. For some types of messages, a buzz on the wrist may be employed to draw the driver's attention to a larger display, such as the dashboard, or projected on the windshield.

Additional embodiments of the present invention can tale into account the driver's position of holding the steering wheel. While the most recommended position to hold the steering wheel is the 10 am and 2 pm positions, other commonly used positions such as holding the steering wheel at the 6 pm position may be employed as well. The additional embodiment can detect when a driver switches between various positions and warns the driver when none of the standard positions are employed. The notification model can also incorporate data received from onboard navigational systems, such as the global positioning satellite (GPS) system to adjust the notifications depending on the type of road or part of road the driver is on. Navigational information, such as upcoming required turns, advanced warnings of dangerous situations (such as accident prone intersections), and traffic alerts can also be provided through the vibro-tactile feedback, thereby augmenting real time navigational and traffic information displays. Additional information that could be supplied to the model includes time of day (lighting conditions), how long the driver has been on the road (fatigue factor), the driver's experience and accident record, etc. Logs of vibro-tactile sensor data correlated GPS and map data can allow drivers to study and improve their driving technique. The logs can also be utilized to analyze accidents and determine if driver inattention was the cause. With additional sensors, a wrist mounted computer could also measure the pulse rate of the driver and sense when the driver is more tense than usual and adjust system parameters accordingly, such as decreasing the volume on the radio. Integration with other on board vehicle sensors could provide vibro-tactile feedback if the driver is attempting to change lanes unsafely.

While accelerometers mounted to the vehicles chassis help disambiguate wrist-movement during vehicle motion, further disambiguation of the wrist mounted vibro-tactile feedback mechanism (IBM's WatchPad) can be accomplished by integrating separate sensors directly into the steeling wheel. Radio frequency identification (RFID) readers/sensors embedded into the steering wheel and an RFID tag integrated into the wrist mounted device (WatchPad) can differentiate specific wrist positions that do not indicate driving. For example, if the driver is resting their hand upon the dashboard, their wrist might be in the correct position to indicate a driving activity to the sensor system; however with the RFID sensor also present a determination that the driver's hand is not upon the steering wheel can be made. The use of RFID in this embodiment of the invention eliminates the need for accelerometers in the wrist mounted vibro-tactile feedback mechanism (WatchPad) for purposes of hand position detection, but the vibro-tactile feedback feature is still utilized. However, the accelerometers in the WatchPad can be used to detect other activities, such as drinking, eating, or holding a cellular phone while the vehicle is in motion.

By affixing several fixed body worn sensors to the driver, readers mounted in different positions within the vehicle can detect the overall driver position as well as the position of the driver's limbs. For example, it can be determined if the driver's RFID tags or Bluetooth devices in the driver's shoes are in close proximity to the brake pedal equipped with an embedded signal reader. Head mounted sensors (such as in a hat or vision wear) utilizing RFID tags or Bluetooth devices, for example, can be used (perhaps in conjunction with a camera) to detect the drivers head position, and if they are dozing off.

Embedded pressure sensitive switches in the steering wheel can also be employed to detect when a driver has their hands on the wheel. If a non-optimal grip condition is determined—such as only one hand on the wheel for a predetermined (programmable) interval—the onboard vehicle system can provide a visual and/or audible waning to the driver. In instances of potential driver incapacitation deduced from both of their hands being off the steering wheel for a prolonged interval, the onboard vehicle system can take proactive steps such as turning on the vehicles flashers, slowing the vehicle down, and initiating an emergency call if the vehicle is equipped with a two way communication system.

Figure 3:
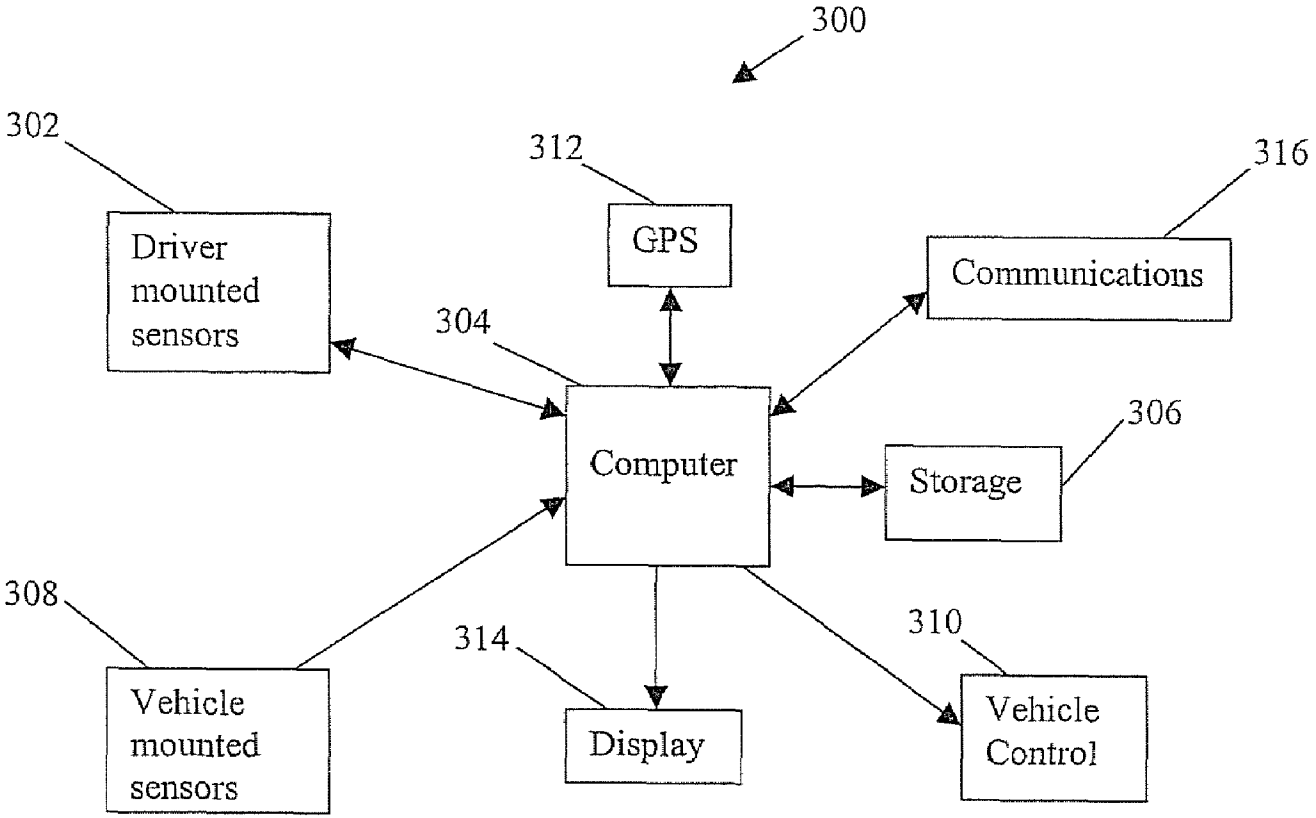
FIG. 3 is a block diagram of the major system components employed in embodiments of the invention.

FIG. 3 is a block diagram of an exemplary system 300 for implementing the driver monitoring and feedback provided by embodiments of the present invention. Driver worn sensors 302 are in two-way electrical communication with a vehicle onboard computer 304 that has a storage medium 306. A series of vehicle sensors 308 are in electrical communication with the onboard computer 304. The driver worn sensors 302 can be in the form of a wrist mounted vibro-tactile feedback mechanism (WatchPad), RFID tags, Bluetooth enabled sensors, and accelerometer devices, amongst others. The vehicle sensors 308 provide key parameters such as velocity; engine operating conditions, and vehicle handling information, etc. The onboard computer 304 gathers inputs from the sensors 302 and 308, as well as providing feedback to the driver through sensors 302 and vehicle operating and control equipment 310. In addition, optional equipment such as GPS 312, in vehicle display 314, and communication equipment 316 are connected to the onboard computer 304. A storage unit records the data obtained by the sensors (302,308), and logs key parameters related to driver behavior and activities, as well as vehicle performance.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

While the preferred embodiments to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A method for enhancing driver safety through body part position monitoring with remote sensors, and furnishing feedback in response to vehicle motion, driver activities, and external driving conditions, wherein the method comprises:

monitoring signals from at least one sensor mounted on a body part of a driver;

monitoring signals from at least one vehicle mounted sensor;

determining driver activity based on the signals from the driver and vehicle mounted sensors; and providing vibro-tactile feedback to the driver based on the determined driver activity, vehicle motion, and external driving conditions, the feedback having a duration based on a stress level the driver is experiencing.

2. The method of claim 1, wherein:

the determining of driver activity is based on correlating accelerometer data from a sensor mounted on a upper limb of the driver with corresponding driver steering wheel control actions.

3. The method of claim 1, wherein:

the vibro-tactile feedback has a specified pattern; and wherein the vibro-tactile feedback alerts the driver without the knowledge of passengers in the vehicle.

4. The method of claim 1 wherein:

the duration of the vibro-tactile feedback is about 3 seconds based on a high stress level activity.

5. The method of claim 3, wherein:

the pattern of the vibro-tactile feedback is based on a stress level that the driver is experiencing as a result of the driving activity, vehicle motion, and external driving conditions.

6. The method of claim 1, wherein:

the vibro-tactile feedback is directly applied to the part of the driver's body requiring behavior modification.

7. The method of claim 1, wherein:

the providing of vibro-tactile feedback to the driver is through a wrist mounted device.

8. A system for enhancing driver safety through body part position monitoring with remote sensors, and furnishing feedback in response to vehicle motion, driver activities, and external driving conditions, the system comprising:

a network of sensors including at least one sensor mounted on a body part of the driver, and at least one vehicle mounted sensor;

a computing device in electrical signal communication with a network of sensors;

wherein the computing device is configured to execute electronic software that manages the network of sensors;

wherein the electronic software is resident on a storage medium in signal communication with the computing device; and wherein the electronic software determines driver activity based on the signals from the driver and vehicle mounted sensors, and provides vibro-tactile feedback to the driver based on the determined driver activity, vehicle motion, and external driving conditions, the vibro-tactile feedback having a duration based on a stress level the driver is experiencing; and wherein the feedback is employed to modify driver behavior and enhance driver safety.

9. The system of claim 8, wherein:

the determining of driver activity is based on correlating accelerometer data from the sensor mounted on an upper limb of the driver with corresponding driver steering wheel control actions.

10. The system of claim 8, wherein:

the vibro-active feedback has a specified pattern.

11. The system of claim 1, wherein the duration of the vibro-tactile feedback is inversely proportional to the stress level.

12. The system of claim 10, wherein:

the pattern of the vibro-tactile feedback is based on a stress level that the driver is experiencing as a result of the driving activity, vehicle motion, and external driving conditions.

13. The system of claim 8, wherein:

the vehicle mounted sensors are embedded in a steering wheel; and wherein the embedded sensors within the steering wheel further comprise:

pressure sensitive switches; and wherein the pressure sensitive switches can detect when the driver has their hands on the wheel, or if the drivers hands are in a non-optimal position.

14. The system of claim 8, wherein:

the vibro-tactile feedback is directly applied to the part of the driver's body requiring behavior modification.

15. The system of claim 8, wherein:

the providing of vibro-tactile feedback to the driver is through a wrist mounted device.

16. The system of claim 8, wherein:

the sensor is mounted on the upper limb of a driver and employs Radio Frequency Identification (RFID) tags and readers embedded in a vehicle's steering wheel to determine the proximity of the drivers hands to the vehicle's steering wheel.

17. The system of claim 8, wherein:

the sensor is mounted on the upper limb of a driver and employs Bluetooth transmission and receivers embedded in a vehicle's steering wheel to determine the proximity of the driver's hands to the vehicle's steering wheel.

18. An article comprising machine-readable storage media containing instructions that when executed by a processor enable the processor to manage a system for enhancing driver safety through body part position and vehicle monitoring with remote sensors in electrical communication with a computing device, and furnishing feedback in response to vehicle motion, driver activities, and external driving conditions, wherein the instructions comprise:

monitoring signals from at least one sensor mounted on a body part of a driver;

monitoring signals from at least one vehicle mounted sensor;

determining driver activity based on the signals from the driver and vehicle mounted sensors; and providing vibro-tactile feedback to the driver based on the determined driver activity, vehicle motion, and external driving conditions, the vibro-tactile feedback having a duration based on a stress level the driver is experiencing.

19. The article of claim 18, wherein:

the instructions, in response to correlating accelerometer data from a sensor mounted on the upper limb of the driver with corresponding driver steering wheel control actions provides vibro-tactile feedback to the driver having a specified pattern; and the pattern and duration of the vibro-tactile feedback is based on a stress level that the driver is experiencing as a result of the driving activity, vehicle motion, and external driving conditions.

* * * * *